United States Patent [19]

Fuller

[11] 4,397,363

[45] Aug. 9, 1983

[54] ROTARY DRILL BITS AND METHOD OF USE

[75] Inventor: John M. Fuller, Gloucester, England

[73] Assignee: Drilling & Service U.K. Limited, Gloucester, England

[21] Appl. No.: 222,142

[22] Filed: Jan. 2, 1981

[30] Foreign Application Priority Data

Jan. 10, 1980 [GB] United Kingdom ..... 8000606

[51] Int. Cl.[3] ..... E21B 10/18

[52] U.S. Cl. ..... 175/410; 175/394

[58] Field of Search ..... 175/317, 318, 410, 409, 175/394–396, 417, 418, 429

[56] References Cited

U.S. PATENT DOCUMENTS 2,264,617 12/1941 Carpenter et al. .
2,365,941 12/1944 Crake .
2,371,489 3/1945 Williams, Jr. .
2,809,808 10/1957 Catallo .
2,838,284 6/1958 Austin .
3,158,216 11/1964 Baron et al. ..... 175/410 X
3,709,308 1/1973 Rowley et al. .
3,727,704 4/1973 Abplanalp .
3,915,246 10/1975 Sheshtawy .

FOREIGN PATENT DOCUMENTS 1054039 4/1959 Fed. Rep. of Germany ..... 175/329

*Primary Examiner*—Stephen J. Novosad
*Assistant Examiner*—Thuy M. Bui
*Attorney, Agent, or Firm*—Cushman, Darby & Cushman

[57] ABSTRACT

A rotary drill bit for use in subsurface formations includes fluid channels for the passage of drilling mud to remove cuttings. According to the invention to clear blockages there are only one or two unbranched channels for the passage of mud past the cutting elements and these are arranged in a spiral.

12 Claims, 5 Drawing Figures

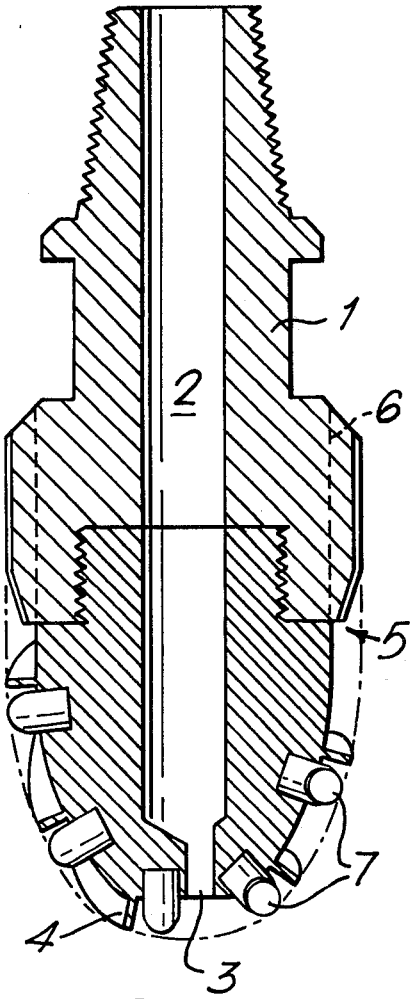
FIG.2.
FIG.1.
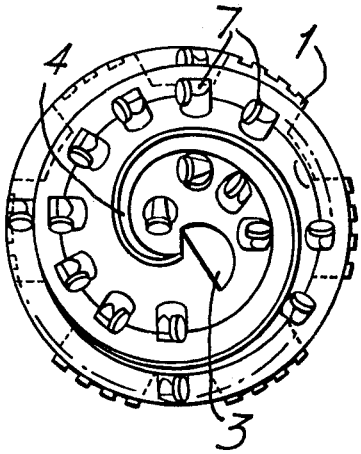
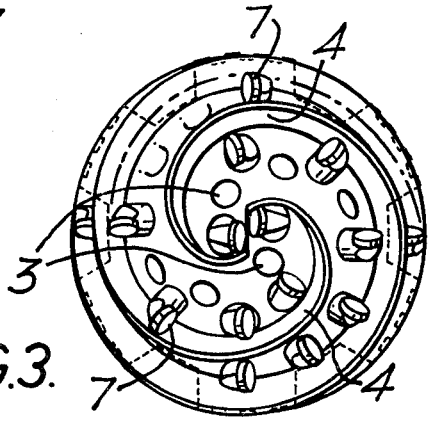
FIG.3.

ROTARY DRILL BITS AND METHOD OF USE

BACKGROUND AND SUMMARY OF THE INVENTION

The invention relates to rotary drill bits and a method of use and in particular to such bits which are used to drill holes in subsurface formations to extract oil, gas or water or in mining or in the removal of cores.

The drill bits comprise a bit body having a passageway within the body, e.g. for a fluid such as a drilling mud, opening at an external surface of the body, elements being mounted on the external surface of the body and many fluid channels extending from the passageway opening and past some of the elements. The elements may be formed of diamond, synthetic diamonds or the like and they may cut into the formation by a true cutting action or by an abrading action. Such bits are disclosed in, for example, U.S. Pat. Nos. 2,371,489, 2,809,808, 3,709,308 and 3,727,704. In use of such a drill bit, drilling fluid is pumped through the fluid passage within the bit body and emerges through the opening and flows upwardly along the many fluid channels. The fluid flushes cuttings away from the drill bit and cleans and cools the cutting or abrading elements, and to a certain extent cools the formation being drilled.

In known drill bits of this type the opening or openings are usually located in the region of the central axis of the bit, and there are many fluid channels which extend away from the centre of the bit. There must be sufficient fluid channels or waterways to ensure that cuttings are removed from all parts of the bit and depending on the design there can be as many as 30 waterways. The channels are often substantially straight as viewed axially of the bit, but they may also have a circumferential component so as to impart a somewhat spiral flow to the fluid as it flows away from the opening or openings in the region of the central axis of the bit.

In all drill bits of this type there is a tendency for the channels to be blocked by cuttings removed from the formation, and where there are many channels, blockage of one channel means that its associated cutting elements are not cooled and cleaned and the remaining channels have to cope with the entire flow of fluid. Although there will result some increase in pressure in the channels which remain unblocked, this increase in pressure will not generally be sufficient to unblock the blocked channel, so that the cutters associated with that channel will become substantially ineffective through overheating and clogging, which presents a barrier between the formation and the cutting element. This problem is more pronounced when the drill bit is used with a water-based mud, which has a greater tendency than oul-based invert emulsion mud to allow the cuttings to block the drilling fluid channels. There is a great risk of a blockage when drilling in a plastic formation, e.g., claystone, shale.

According to one aspect of the present invention, there is provided a rotary drill bit for use in subsurface formations comprising a bit body, a passageway within the body, e.g. for a drilling fluid such as a mud, opening at an external surface of the body, elements mounted on the external surface of the body for cutting or abrading the formation, a plurality fluid channels extending from the passageway opening and past some of the elements, characterised in fluid unbranched channels, which are arranged to cause the fluid to flow past a plurality of the elements.

Our investigations have shown that where the drilling fluid is arranged to flow in only one path along a fluid channel there are surprising advantages. If a blockage occurs in the channel the resulting constriction will cause the fluid pressure upstream of the blockage to rise substantially and this will tend to break down a partial or full blockage and so clear it.

Most preferably one elongate channel is present and extends in a spiral about the bit in the region of the cutting elements. There may also be two generally parallel channels each arranged in a helix and extending away from the passageway opening, preferably on diametrically opposite sides thereof. When a blockage occurs in the case of a channel arranged in a spiral, in a convolution there will be a substantial rise in fluid pressure on the upstream side of the blockage. This convolution will be closely within the convolution on the immediate downstream side of the blockage, so that there will be a large pressure difference across the land between the two convolutions. The fluid will tend to flow from the upstream convolution into the downstream convolution, due to this pressure difference, thus effectively by-passing the blockage and ensuring that cutting elements downstream of the blockage are still adequately cooled and cleaned.

Sometimes the downstream end of said spiral channel leads into an annular channel encircling the bit body and where the bit includes a gauge portion the annular channel may encircle the bit body adjacent the gauge portion.

In one preferred embodiment the fluid channel is of approximate uniform corss-sectional shape over most of its length. The cutting elements which are most preferably "preforms" are located in the channel in the floor or sidewalls thereof, advantageously being set into the floor or walls in such a way as not to interrupt the fluid flow.

The invention further includes a method of drilling a hole in an underground formation by means of a rotary drill bit and passing drilling mud through the bit to wash away cuttings, characterised in that the bit used is according to this invention and in that drilling fluid is passed unidirectionally along one or both of the one or two fluid channels to remove the cuttings.

Water-based muds are often preferred compared to oil-based muds and use of a bit of the invention reduces the risk of blockages when using such muds.

BRIEF DESCRIPTION OF THE DRAWINGS

In order that the invention may be well understood, it will be described by way of example with reference to the accompanying diagrammatic drawings, in which FIG. 1 and FIG. 2 are respectively an end view and axial cross-section of one bit;

FIG. 3 is an end view of another bit; and

DETAILED DESCRIPTION OF THE DRAWINGS

Figure 4:
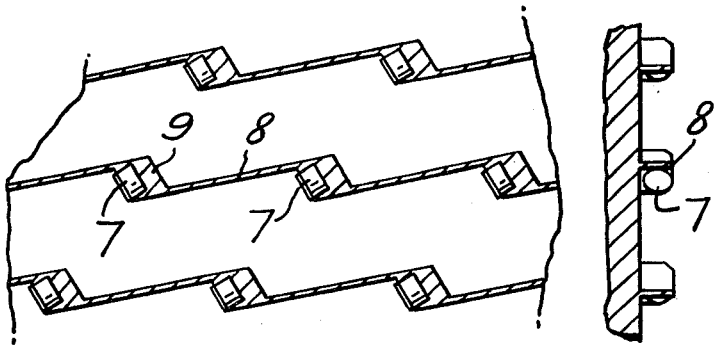
FIGS. 4 and 5 show two different forms of convolutions of spiral fluid channel.

In the embodiment of FIGS. 1 and 2, a rotary drill bit for use in boring a deep hole in a plastic formation comprises a body 1 having an axial bore 2 opening a the free end face of the bit at an opening 3. A fluid channel is formed in the external face of the bit body 1 by sidewalls 4, and the channel spirally winds away from the opening 3 up the body to join a channel 5 adjacent the gauge portion 6. In the embodiment of FIG. 3, two such channels 4 are present in generally parallel relation and each spirals away from the opening 3 on opposite sides thereof. In each case preform cutters 7 are present in the floor of the channel 4. In use, drilling mud is pumped down the bore 2 and the mud flows along the channel 4 to clear cuttings away and cool the cutters 7. Because of the unidirectional flow of the drilling mud the cuttings were cleared away without any problem, any blockages being forced along the channels by the increased fluid pressure they themselves caused.

Figure 5:
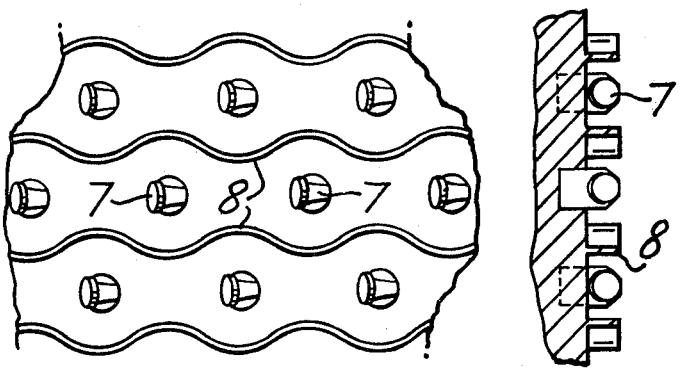

FIGS. 4 and 5 show detailed ways of setting the preforms 7 in the channels 4 in such a way as to minimize disruption of the flow of drilling mud. The walls 8 of the channels are, in the case of FIG. 4, stepped as at 9, and the cutters 7 are set in the relieved portions. In the case of FIG. 5, the cutters 7 are set in the floor and the walls 8 are sinusoid to minimise changes in mud velocity flowing along the unbranched channels.

Because of the improved flow of drilling mud fewer cutting elements become damaged and so fewer need be mounted in the drill bit.

I claim:

1. A rotary drill bit having a gauge region and for use in subsurface formations, comprising: a bit body; means defining a passageway within the body and adapted to carry a mud or like drilling fluid, and having an outlet opening at an external surface of the body; a single unbranched, continuous elongate channel extending from the outlet opening of the passageway and around the body in a spiral to adjacent the gauge region thereof; cutting or abrading means for cutting or abrading the formation, mounted substantially in the channel so that the fluid is caused to flow in one path past the cutting or abrading means to clear away cuttings and to break down any blockage in the channel caused by cuttings, said cutting or abrading means comprising a plurality of discrete cutting or abrading elements.

2. A bit according to claim 1 wherein the land between adjacent convolutions comprises an upstanding wall.

3. A bit according to claim 1 wherein the channel is of approximate uniform cross-sectional shape over most of its length.

4. A bit according to claim 1 wherein the channel is defined by a floor and sidewalls, and wherein the elements are set into the floor or sidewalls of the channel so as to cause minimal interruption of the flow of fluid therealong.

5. A bit according to claim 4 wherein a sidewall of the channel is recessed or relieved to receive an element.

6. A bit according to claim 1 wherein the channel is defined by a floor and sidewalls, and wherein a sidewall of the channel is recessed or relieved to receive an element.

7. A rotary drill bit having a gauge region and for use in subsurface formations comprising: a bit body; means defining a passageway within the body and adapted to carry a mud or like drilling fluid, and having an outlet opening at an external surface of the body; two, and only two, unbranched, continuous, generally parallel elongate channels extending from the outlet opening of the passageway and around the body in a spiral to points adjacent the gauge region thereof; cutting or abrading means, for cutting or abrading the formation, mounted substantially in the channel, so that the fluid is caused to flow in two paths past the cutting or abrading means to clear away cuttings and to break down any blockage in the channel caused by cuttings, said cutting or abrading means comprising a plurality of discrete cutting or abrading elements.

8. A bit according to claim 7 wherein the land between adjacent convolutions comprises an upstanding wall.

9. A bit according to claim 7 wherein each channel of approximate uniform cross-sectional shape over most of its length.

10. A bit according to claim 7 wherein each channel is defined by a floor and sidewalls, and wherein a sidewall of each channel is recessed or relieved to receive an element.

11. A bit according to claim 7 wherein each channel is defined by a floor and sidewalls, and wherein the elements are set into the floor or sidewalls of each channel so as to cause minimal interruption of the flow of fluid therealong.

12. A bit according to claim 11 wherein a sidewall of each channel is recessed or relieved to receive an element.

* * * * *

UNITED STATES PATENT AND TRADEMARK OFFICE

CERTIFICATE OF CORRECTION

PATENT NO. : 4,397,363

DATED : August 9, 1983

INVENTOR(S) : FULLER

It is certified that error appears in the above-identified patent and that said Letters Patent is hereby corrected as shown below:

On the Title Page

[30] Foreign Application Priority Data should read:

--Jan. 16, 1980 [GB] United Kingdom.....8001489--

Signed and Sealed this

Twentieth Day of September, 1988

*Attest:*

DONALD J. QUIGG

*Attesting Officer*

*Commissioner of Patents and Trademarks*